US005992836A

United States Patent [19]

Howe

[11] Patent Number: 5,992,836

[45] Date of Patent: Nov. 30, 1999

[54] ADJUSTABLE ANGLE CORNER BLOCK

[76] Inventor: Justin Howe, 8 W. Washington St., Algonquin, Ill. 60102

[21] Appl. No.: 09/116,979

[22] Filed: Jul. 16, 1998

[51] Int. Cl.[6] ..... B25B 1/20

[52] U.S. Cl. ..... 269/41; 269/37; 269/2; 269/152

[58] Field of Search ..... 269/41, 76, 311, 269/155, 2, 147–149, 152, 37

[56] References Cited

U.S. PATENT DOCUMENTS

| | | | |
|---|---|---|---|
| D. 279,646 | 7/1985 | Ferdinand et al. | 269/95 |
| 1,221,897 | 4/1917 | Pall | 269/76 |
| 1,987,826 | 1/1935 | Heumann | 269/152 |
| 4,132,396 | 1/1979 | Graham | 269/41 |
| 4,984,775 | 1/1991 | Kahlke | 269/41 |
| 5,234,204 | 8/1993 | Hunt | 269/41 |
| 5,704,599 | 1/1998 | Slothower | 269/41 |

*Primary Examiner*—David A. Scherbel
*Assistant Examiner*—Lee Wilson

[57] ABSTRACT

An adjustable angle corner block for holding objects together at an angle with respect to each other. The adjustable angle corner block includes first and second plates with the proximal end edges of the plates pivotally coupled together. A holding device is provided for releasably holding the plates in a position with respect to each other such that the plates cannot pivot out of the position when held by the holding device. Each of the plates has a mounting tube coupled to the back surface of the plate such that a first mounting tube is coupled to the back surface of the first plate and a second mounting tube is coupled to the back surface of the second plate. Each of the mounting tubes is adapted for receiving a threaded end of a pipe of a pipe clamp therein.

11 Claims, 3 Drawing Sheets

ADJUSTABLE ANGLE CORNER BLOCK

BACKGROUND OF THE INVENTION

1. Field of the Invention

The present invention relates to clamping devices and more particularly pertains to a new adjustable angle corner block for holding objects together at an angle with respect to each other.

2. Description of the Prior Art

The use of clamping devices is known in the prior art. More specifically, clamping devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art clamping devices include U.S. Pat. No. 4,984,775; U.S. Pat. No. 4,027,866; U.S. Pat. No. 4,061,321; U.S. Pat. No. 5,192,060; U.S. Pat. No. 4,881,726; and U.S. Pat. No. Des. 279,646.

While these devices fulfill their respective, particular objectives and requirements, the aforementioned patents do not disclose a new adjustable angle corner block. The inventive device includes first and second plates with the proximal end edges of the plates pivotally coupled together. A holding device is provided for releasably holding the plates in a position with respect to each other such that the plates cannot pivot out of the position when held by the holding device. Each of the plates has a mounting tube coupled to the back surface of the plate such that a first mounting tube is coupled to the back surface of the first plate and a second mounting tube is coupled to the back surface of the second plate. Each of the mounting tubes is adapted for receiving a threaded end of a pipe of a pipe clamp therein.

In these respects, the adjustable angle corner block according to the present invention substantially departs from the conventional concepts and designs of the prior art, and in so doing provides an apparatus primarily developed for the purpose of holding objects together at an angle with respect to each other.

SUMMARY OF THE INVENTION

In view of the foregoing disadvantages inherent in the known types of clamping devices now present in the prior art, the present invention provides a new adjustable angle corner block construction wherein the same can be utilized for holding objects together at an angle with respect to each other.

The general purpose of the present invention, which will be described subsequently in greater detail, is to provide a new adjustable angle corner block apparatus and method which has many of the advantages of the clamping devices mentioned heretofore and many novel features that result in a new adjustable angle corner block which is not anticipated, rendered obvious, suggested, or even implied by any of the prior art clamping devices, either alone or in any combination thereof.

To attain this, the present invention generally comprises first and second plates with the proximal end edges of the plates pivotally coupled together. A holding device is provided for releasably holding the plates in a position with respect to each other such that the plates cannot pivot out of the position when held by the holding device. Each of the plates has a mounting tube coupled to the back surface of the plate such that a first mounting tube is coupled to the back surface of the first plate and a second mounting tube is coupled to the back surface of the second plate. Each of the mounting tubes is adapted for receiving a threaded end of a pipe of a pipe clamp therein.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new adjustable angle corner block apparatus and method which has many of the advantages of the clamping devices mentioned heretofore and many novel features that result in a new adjustable angle corner block which is not anticipated, rendered obvious, suggested, or even implied by any of the prior art clamping devices, either alone or in any combination thereof.

It is another object of the present invention to provide a new adjustable angle corner block which may be easily and efficiently manufactured and marketed.

It is a further object of the present invention to provide a new adjustable angle corner block which is of a durable and reliable construction.

An even further object of the present invention is to provide a new adjustable angle corner block which is susceptible of a low cost of manufacture with regard to both materials and labor, and which accordingly is then susceptible of low prices of sale to the consuming public, thereby making such adjustable angle corner block economically available to the buying public.

Still yet another object of the present invention is to provide a new adjustable angle corner block which provides in the apparatuses and methods of the prior art some of the advantages thereof, while simultaneously overcoming some of the disadvantages normally associated therewith.

Still another object of the present invention is to provide a new adjustable angle corner block for holding objects together at an angle with respect to each other.

Yet another object of the present invention is to provide a new adjustable angle corner block which includes first and second plates with the proximal end edges of the plates pivotally coupled together. A holding device is provided for releasably holding the plates in a position with respect to each other such that the plates cannot pivot out of the position when held by the holding device. Each of the plates has a mounting tube coupled to the back surface of the plate such that a first mounting tube is coupled to the back surface of the first plate and a second mounting tube is coupled to the back surface of the second plate. Each of the mounting tubes is adapted for receiving a threaded end of a pipe of a pipe clamp therein.

Still yet another object of the present invention is to provide a new adjustable angle corner block that allows accurate joints to be formed and held in place while setting.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
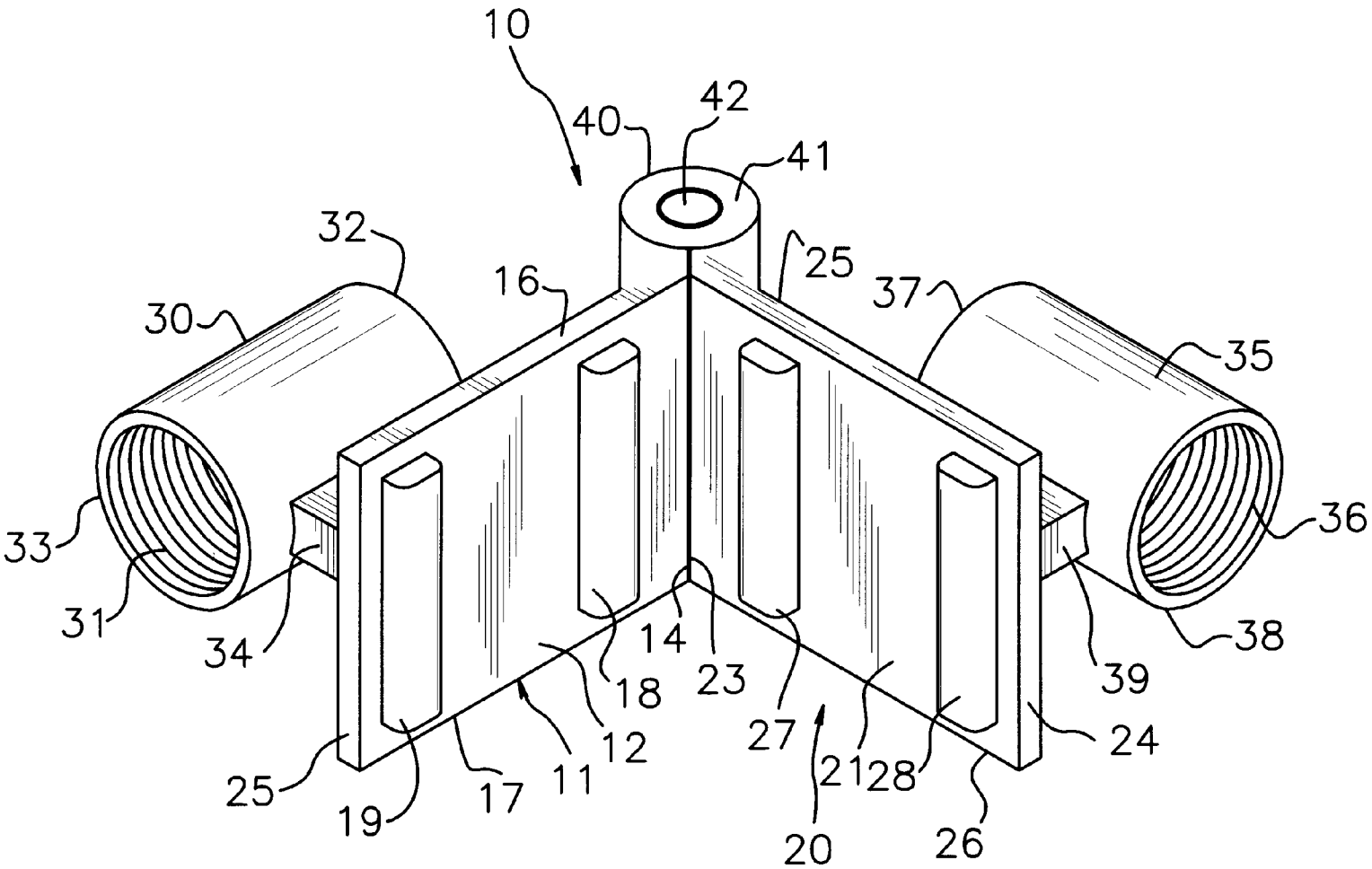
FIG. 1 is a schematic front perspective view of a new adjustable angle corner block according to the present invention.
Figure 3:
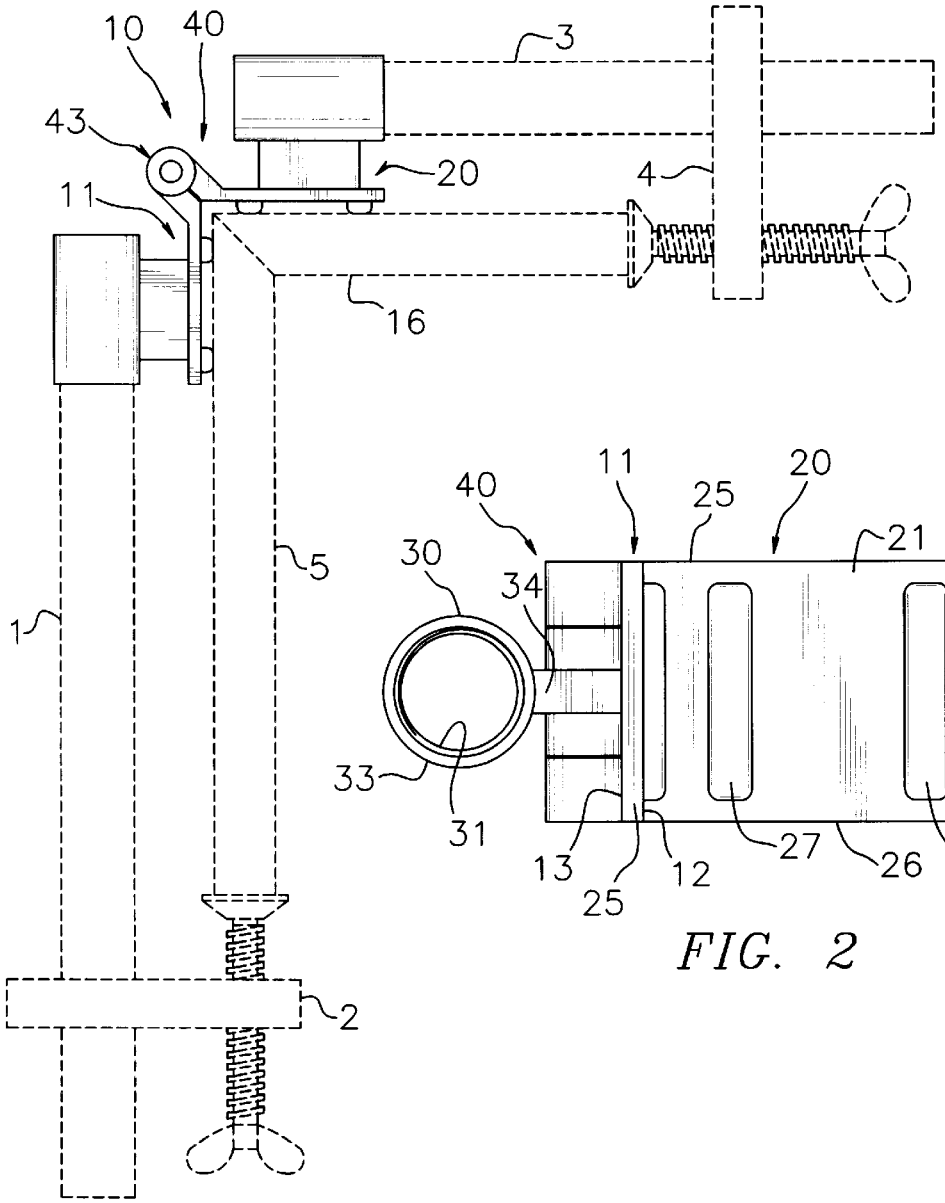
FIG. 3 is a schematic top plan view of the present invention in use clamping to building elements together.
Figure 2:
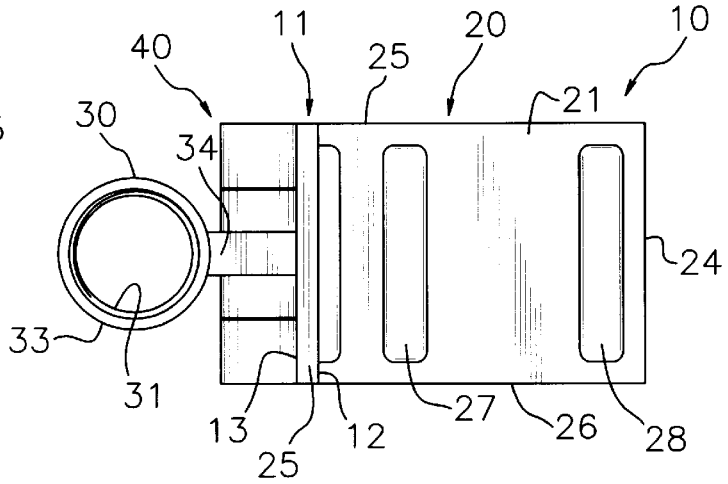
FIG. 2 is a schematic side view of the present invention.
Figure 4:
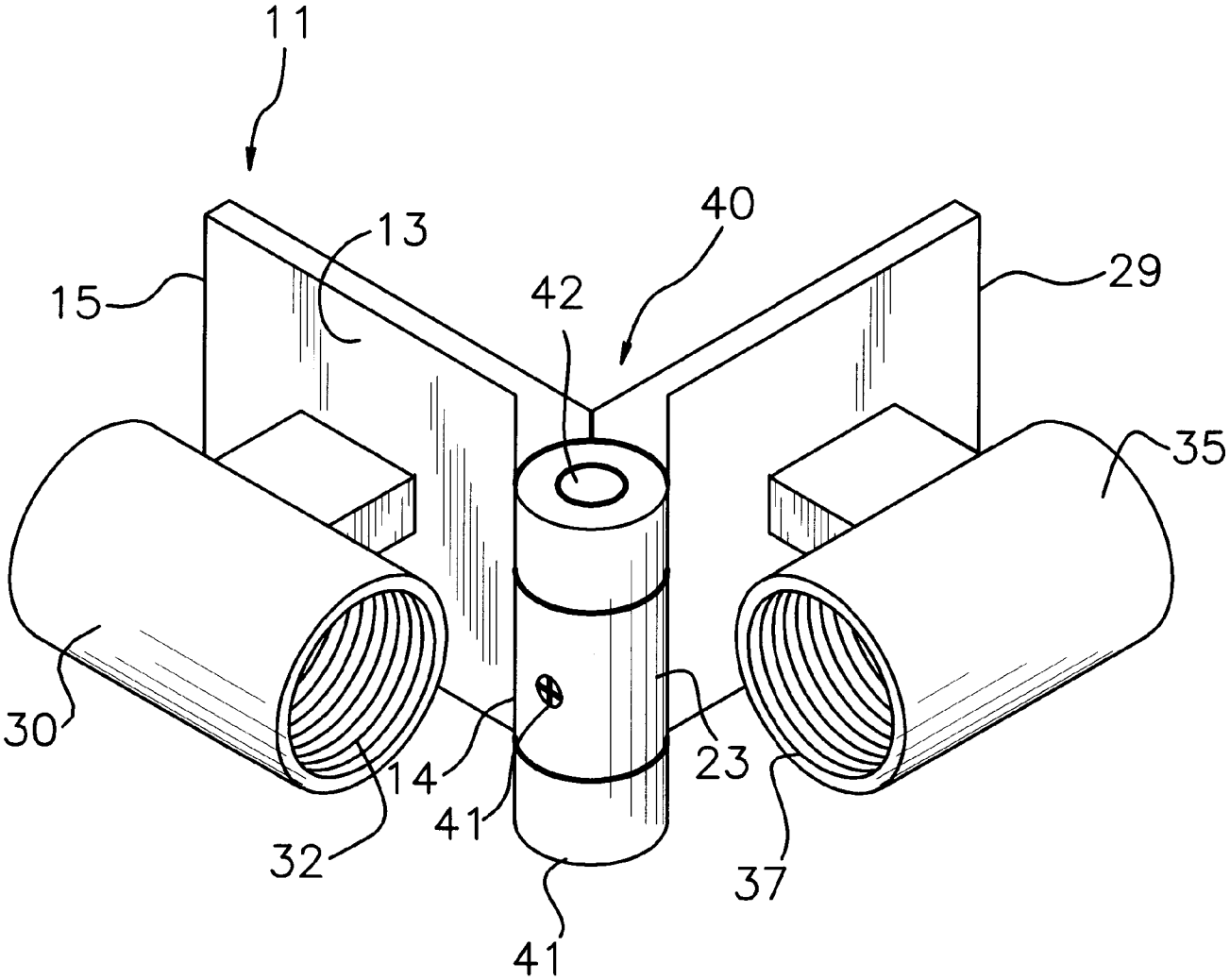
FIG. 4 is a schematic back perspective view of the present invention.

With reference now to the drawings, and in particular to FIGS. 1 through 4 thereof, a new adjustable angle corner block embodying the principles and concepts of the present invention and generally designated by the reference numeral 10 will be described.

The adjustable angle corner block is designed for use as a part of a pipe clamp assembly with a pair of elongate pipes 1,3 each having a threaded end, and a sliding jaw assembly 2,4 slidably mounted on each of the pipes. As best illustrated in FIGS. 1 through 4, the adjustable angle corner block 10 generally comprises first and second plates 11,20 with the proximal end edges 14,23 of the plates 11,20 pivotally coupled together. A holding device 43 is provided for releasably holding the plates 11,20 in a position with respect to each other such that the plates 11,20 cannot pivot out of the position when held by the holding device 43. Each of the plates 11,20 has a mounting tube 30,35 coupled to the back surface 13,22 of the plate such that a first mounting tube 30 is coupled to the back surface 13 of the first plate 11 and a second mounting tube 35 is coupled to the back surface 22 of the second plate 20. Each of the mounting tubes is adapted for receiving a threaded end of a pipe 1,2 of a pipe clamp therein.

In closer detail, each of the plates 11,20 is generally rectangular and has front and back surfaces 12,21,13,22, proximal and distal end edges 14,23,15,24 and a pair of side edges 16,25,17,26 extending between the end edges of the associated plate. Preferably, the front and back surfaces of each of the plates are generally planar. The end edges and the side edges of each of the plates 11,20 are preferably generally straight. The proximal end edges 14,23 of the plates 11,20 are pivotally coupled together along their length such that the plates 11,20 are pivotable about an axis extending parallel to their proximal end edges. One of the side edges 16,25 of each of the plates 11,20 is coplanar to one another while the other side edge 17,26 of the each of the plates 11,20 is coplanar to one another. The plates 11,20 is pivotable such that the front surfaces 12,21 of the plates 11,20 are pivotable to a position where they face each other and also to a position where they are coplanar with each other. Preferably, a hinge portion 40 pivotally couples the proximal end edges of the plates 11,20 together. The hinge portion 40 has a barrel 41 has a central bore and a pivot pin 42 extending through the central bore of the barrel 41. The barrel 41 has a length and a plurality of knuckles arranged in a row along the length of the barrel 41. The proximal end edge of each plate are coupled to alternating knuckles of the row of knuckles. A holding device 43 is provided for releasably holding the plates 11,20 in a position with respect to each other such that the plates 11,20 cannot pivot out of the position when held by the holding device 43. Ideally, the holding device 43 comprises a set screw is threadedly extended into the barrel 41 of the hinge portion 40 to abut against the pivot pin 42.

In use, the front surfaces 12,21 of the plates 11,20 are designed for abutting against a pair of abutting objects such as two building elements 5,6 forming a joint. The front surface of each of the plates 11,20 preferably has a pair of spaced apart elongate ridges 18,19,27,28 outwardly extending therefrom. Each of the ridges has a length extending between the side edges of the associated plate. One of the ridges 18,27 of each of the plates 11,20 is positioned adjacent the proximal end edge of the associated plate while the other of the ridges 19,28 of the each of the plates 11,20 is positioned adjacent the distal end edge of the associated plate. Each of the ridges has an arcuate or generally D-shaped cross section taken perpendicular to the length of the ridge. The ridges are designed for abutting against the pair of abutting objects positioned adjacent the front surfaces of the plates 11,20. Ideally, each of the ridges comprises a resiliently compressible material such as a resiliently compressible rubber so that the objects are held firmly against the front surfaces of the plates 11,20 and so that the front surfaces of the plates 11,20 do not damage the pair of abutting objects.

A pair of mounting tubes 30,35 are also provided. Each of the mounting tubes is generally cylindrical and has a threaded lumen 31,36 and a pair of generally circular open ends 32,33,37,38 opening into the lumen of the mounting tube. Each of the mounting tubes has a longitudinal axis extending between the ends of the mounting tube. Each of the plates 11,20 has a mounting tube coupled to the back surface of the plate with, a first mounting tube 30 coupled to the back surface 13 of the first plate 11 and a second mounting tube 35 coupled to the back surface 22 of the second plate 20. Ideally, each of the mounting tubes has a generally rectangular elongate extension portion 34,39 coupling the mounting tube to the back surface of the associated plate. Each of the extension portions is extended radially outwards from the associated mounting tube and is also extended generally perpendicular to the back surface of the associated plate. Preferably, each of the extension portions has a length extending between the ends of the associated mounting tube. The extension portion is designed for spacing the mounting tube a distance away from the back surface of the associated plate.

The longitudinal axis of each of the mounting tubes is preferably extended generally parallel to the side edges of the associated plate such that one of the ends of each of the mounting tubes is positioned towards the proximal end edge of the associated plate and another of the ends of each of the mounting tubes is positioned towards the distal end edge of the associated plate. In this preferred embodiment, the ends of each of the mounting tubes lie in planes lie in planes generally perpendicular to the back surface of the associated plate. Ideally, the end of each of the mounting tubes positioned towards the distal end of the associated plate and the distal end of the associate plate generally lie in a common plane.

In use, each of the mounting tubes 30,35 is adapted for receiving a threaded end of a pipe 1,3 of a pipe clamp therein so that the threaded end of one pipe of a pipe clamp is insertable into the open end 33 of the first mounting tube 30 adjacent the distal end edge 15 of the first plate 11 and the threaded end of another pipe of another pipe clamp is insertable into the open end 38 of the second mounting tube 35 adjacent the distal end edge of the second plate 20.

Each of the plates 11,20 has a length defined between the end edges of the plate, a width defined between the side edges of the plate and a thickness defined between the front and back surfaces of the plate. Ideally, the length of each of the plates 11,20 is about 4 inches, the width of each of the plates 11,20 is about 4 inches, and the thickness of each of the plates 11,20 is about ⅛ inch. Each of the mounting tubes has a diameter, and a length defined between the ends of the mounting tube. Preferably, the length of each of the mounting tubes is about one-half the length of each of the plates 11,20, and is ideally, about 2 inches. Each of the extension portions has a width defined between the back surface of the plate and the outer surface of the mounting tube. Ideally, the width of each of the extension portions is equal to the diameter of the mounting tube.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An adjustable angle corner block, comprising:

first and second plates, each of said plates having front and back surfaces, proximal and distal end edges and a pair of side edges extending between said end edges of the associated plate;

said proximal end edges of said plates being pivotally coupled together;

a holding device for releasably holding said plates in a position with respect to each other such that said plates cannot pivot out of the position when held by said holding device;

a pair of mounting tubes including first and second mounting tubes, each of said mounting tubes being generally cylindrical and having a threaded lumen and a pair of generally circular open ends opening into said lumen of said mounting tube, each of said mounting tubes having a longitudinal axis extending between said ends of said mounting tube;

each of said plates having one of said mounting tubes coupled to said back surface of said plate such that said first mounting tube is coupled to said back surface of said first plate and said second mounting tube is coupled to said back surface of said second plate; and each of said mounting tubes being adapted for receiving therein a threaded end of a pipe of a pipe clamp.

2. The adjustable angle corner block of claim 1, wherein said plates are generally rectangular, wherein said front and back surfaces of each of said plates are generally planar, and wherein said end edges and said side edges of each of said plates are generally straight.

3. The adjustable angle corner block of claim 2, wherein one of said side edges of each of said plates are coplanar to one another, another of said side edges of said each of said plates are coplanar to one another.

4. The adjustable angle corner block of claim 1, wherein a hinge portion pivotally couples said proximal end edges of said plates together, said hinge portion having a barrel and a pivot pin extending through said barrel, said barrel having a length and a plurality of knuckles arranged in a row along said length of said barrel, said proximal end edge of each plate being coupled to alternating knuckles of said row of knuckles.

5. The adjustable angle corner block of claim 4, wherein said holding device comprises a set screw being threadedly extended into said barrel of said hinge portion to abut against said pivot pin.

6. The adjustable angle corner block of claim 1, wherein said front surface of each of said plates having a pair of spaced apart elongate ridges outwardly extending therefrom, each of said ridges having a length extending between said side edges of the associated plate.

7. The adjustable angle corner block of claim 6, wherein one of said ridges of each of said plates is positioned adjacent said proximal end edge of the associated plate, and another of said ridges of said each of said plates is positioned adjacent said distal end edge of the associated plate.

8. The adjustable angle corner block of claim 6, wherein each of said ridges comprises a resiliently compressible material.

9. The adjustable angle corner block of claim 1, wherein each of said mounting tubes has a generally rectangular elongate extension portion coupling said mounting tube to said back surface of the associated plate, each of said extension portions having a length extending between said ends of the associated mounting tube.

10. The adjustable angle corner block of claim 1, wherein said ends of each of said mounting tubes lie in planes generally perpendicular to said back surface of the associated plate.

11. An adjustable angle corner block for use a part of a pipe clamp assembly with a pair of elongate pipes each having a threaded end, and a pair of sliding jaw assemblies, one of the sliding jaw assemblies slidably mounted on one of the pipes and the other of the sliding jaw assemblies slidably mounted on the other pipe, said adjustable angle corner block comprising:

first and second plates, each of said plates being generally rectangular and having front and back surfaces, proximal and distal end edges and a pair of side edges extending between said end edges of the associated plate;

wherein said front and back surfaces of each of said plates are generally planar, wherein said end edges and said side edges of each of said plates are generally straight;

said proximal end edges of said plates being pivotally coupled together, one of said side edges of each of said plates being coplanar to one another, another of said side edges of said each of said plates being coplanar to one another;

wherein a hinge portion pivotally couples said proximal end edges of said plates together, said hinge portion having a barrel and a pivot pin extending through said barrel, said barrel having a length and a plurality of knuckles arranged in a row along said length of said barrel, said proximal end edge of each plate being coupled to alternating knuckles of said row of knuckles;

a holding device for releasably holding said plates in a position with respect to each other such that said plates cannot pivot out of the position when held by said holding device, wherein said holding device comprises a set screw being threadedly extended into said barrel of said hinge portion to abut against said pivot pin;

said front surface of each of said plates having a pair of spaced apart elongate ridges outwardly extending therefrom, each of said ridges having a length extending between said side edges of the associated plate, one of said ridges of each of said plates being positioned adjacent said proximal end edge of the associated plate, another of said ridges of said each of said plates being positioned adjacent said distal end edge of the associated plate wherein each of said ridges comprises a resiliently compressible material;

a pair of mounting tubes including first and second mounting tubes, each of said mounting tubes being generally cylindrical and having a threaded lumen and a pair of generally circular open ends opening into said lumen of said mounting tube, each of said mounting tubes having a longitudinal axis extending between said ends of said mounting tube;

each of said plates having one of said mounting tubes coupled to said back surface of said plate such that said first mounting tube is coupled to said back surface of said first plate and said second mounting tube is coupled to said back surface of said second plate;

wherein each of said mounting tubes has a generally rectangular elongate extension portion coupling said mounting tube to said back surface of the associated plate;

said longitudinal axis of each of said mounting tubes being extended generally parallel to said side edges of the associated plate such that one of said ends of each of said mounting tubes is positioned towards said proximal end edge of the associated plate and another of said ends of each of said mounting tubes is positioned towards said distal end edge of the associated plate;

wherein said ends of each of said mounting tubes lie in planes generally perpendicular to said back surface of the associated plate;

wherein said end of each of said mounting tubes positioned towards said distal end of the associated plate and said distal end of the associate plate generally lie in a common plane; and each of said mounting tubes being adapted for receiving therein a threaded end of a pipe of a pipe clamp.

* * * * *